United States Patent [19]

Gamberoni et al.

[11] Patent Number: 5,027,594

[45] Date of Patent: Jul. 2, 1991

[54] EQUIPMENT FOR PRODUCING A YARN HAVING LOOSENED FIBERS AND BINDING THREADS

[75] Inventors: Cecilia Gamberoni; Paolo Ballerini, both of Firenze, Italy

[73] Assignee: 3 B di Ballerini & C. S.n.c., Firenze, Italy

[21] Appl. No.: 266,166

[22] Filed: Nov. 2, 1988

[30] Foreign Application Priority Data

Nov. 13, 1987 [IT] Italy ..... 62-45510
Dec. 30, 1987 [IT] Italy ..... 62-9596A

[51] Int. Cl.[5] ..... D02G 3/42; D04B 9/00

[52] U.S. Cl. ..... 57/24; 057/203; 066/9 B

[58] Field of Search ..... 57/203, 24, 327; 66/9 B, 9 R

[56] References Cited

U.S. PATENT DOCUMENTS 3,153,335 10/1964 Hill ..... 66/9 B
3,645,078 2/1972 Roberts ..... 57/24
3,777,464 12/1973 Gross ..... 57/24
3,999,405 12/1976 Abler et al. ..... 66/9 B

*Primary Examiner*—Stanley N. Gilreath
*Attorney, Agent, or Firm*—McGlew and Tuttle, P.C.

[57] ABSTRACT

Loosened fibers are engaged by means of twisted or knitted binding yarns (FL); a feed roller (210) for the fibers of a roving or fiber top is tangent to a card (206) placed in a housing (212) opening onto a cavity (214) which is essentially tangential to said housing (212), in order to deliver the loosened fibers of the roving in the form of light batting to the binding means.

21 Claims, 5 Drawing Sheets

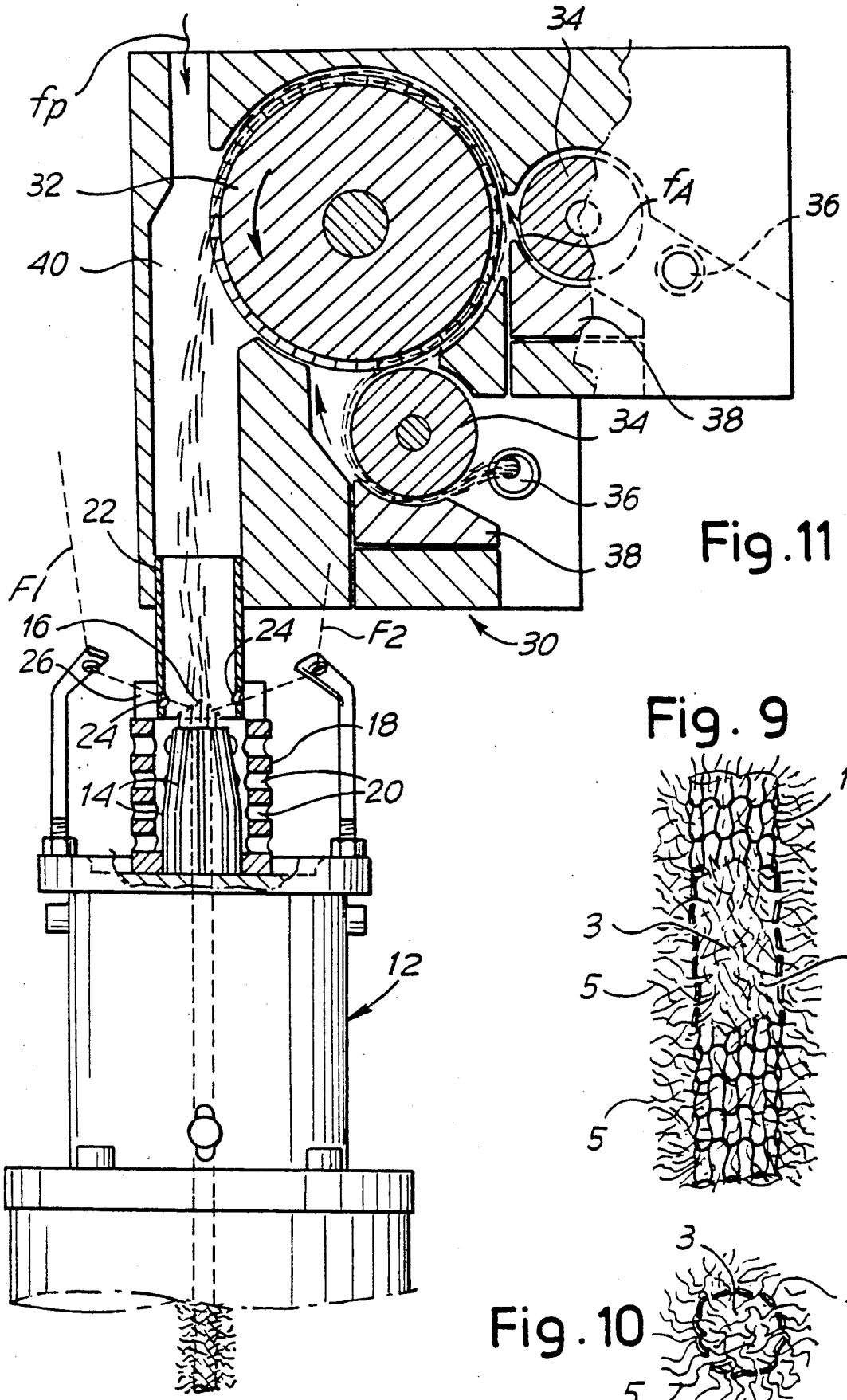
Fig. 11
Fig. 9
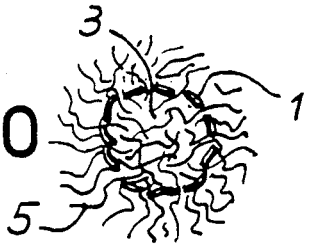
Fig. 10

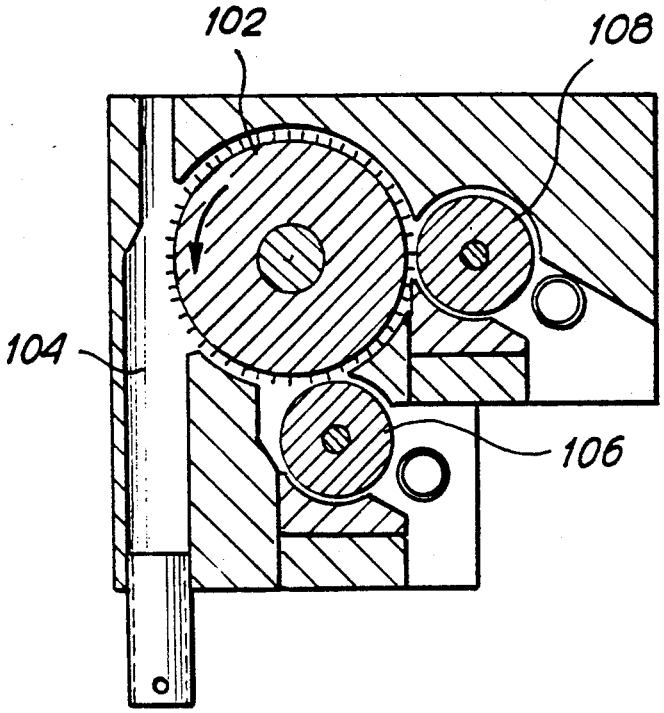
Fig.12
Fig.13
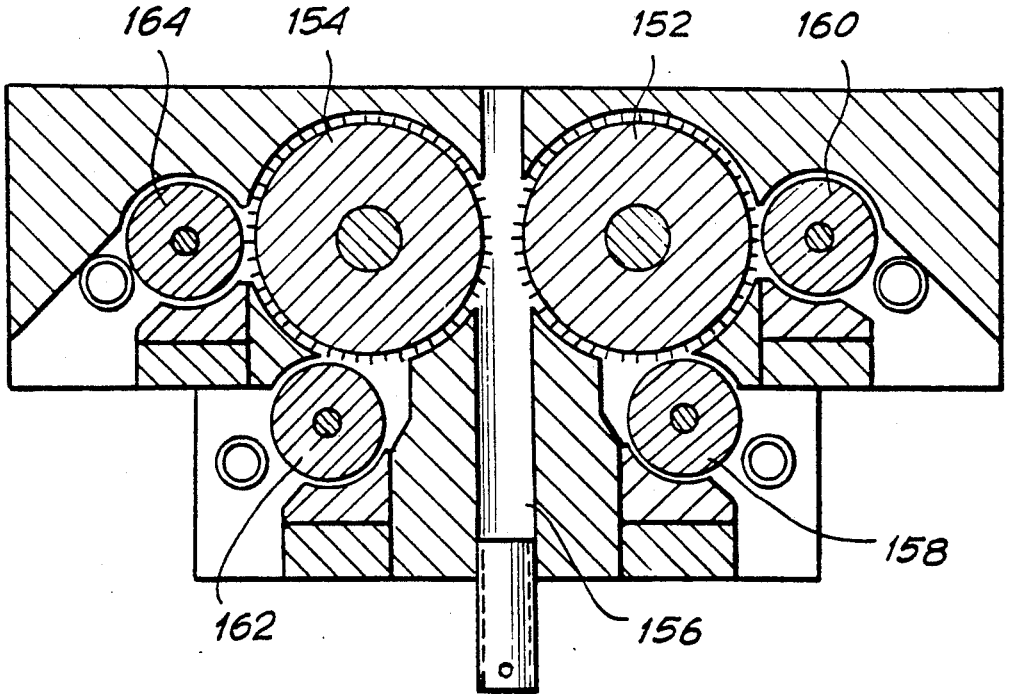

EQUIPMENT FOR PRODUCING A YARN HAVING LOOSENED FIBERS AND BINDING THREADS

FIELD AND BACKGROUND OF THE INVENTION

There are yarns commonly known as raised or matted yarns currently available on the market, obtained by very laborious manufacturing processes involving a plurality of stages through the various operating machines, and in short obtained by an operation of extraction of the fibers (raising) from the processed yarn, involving hard treatment of the material, which beforehand has to undergo the traditional spinning. Moreover, the yarns thus obtained, by virtue of the very characteristics of the operating machines, have a uniform configuration, in the sense that their external characteristics are kept constant.

SUMMARY AND OBJECTS OF THE INVENTION

An object of the invention is to produce a yarn of the raised yarn type, the material of which undergoes the minimum processing and hard treatment. Another object of the invention is to obtain yarns of the raised yarn type, which can assume various configurations, being able to alternate portions of yarn of the raised type, with others of normal twist, and/or flake twist type or the like.

These and other objects and advantages will become clear from the text that follows.

The invention relates to a process for obtaining a yarn of the abovementioned type, to the yarn obtained through said process and to equipment for carrying out the latter.

The process according to the invention for producing a fancy yarn, having a similar aspect to that of the raised, i.e., matted yarn, provides for the fibers of a roving or top to be loosened and thinned in the form of a light batting by means of a card, and for said fibers to be engaged by binding threads so as to protrude from the threadlike manufactured article thus produced. The loosened fibers may be engaged by at least two binding threads arranged in the form of a funnel and twisted so as to form a yarn from which said fibers protrude. Alternatively, a linear knitted manufactured factured article may be produced with at least one binding thread, and the fibers loosened in the form of light batting are fed into the area for producing the knits, as a result of which the loosened fibers are engaged by the said knits, which produces in the linear manufactured article a raising and swelling effect; the linear knitted manufactured article may be produced as a relatively very thin tubular manufactured article, and the loosened fibers are then engaged in the knits both by protruding from the linear manufactured article in the form of raising fibers, and within the tubular manufactured article, with swelling effect in the latter.

The loosened fibers may be supplied by unraveling at least one roving—carded or combed—operated by at least one card tool. The said loosened fibers may be fed to the engaging area via a pneumatic carrier.

A fancy yarn according to the invention is essentially produced by means of binding yarns engaging loosened fibers which protrude from said binding yarns. The binding yarns may be twisted and the fibers are engaged into them. Alternatively the fancy yarn consists of a linear knitted manufactured article, to whose knits loosened fibers are engaged, which loosened fibers produce a raising and swelling effect; said linear manufactured article may advantageously be a knitted tubular manufactured article, having fibers which are anchored to the knits and which protrude at least in part outwardly, in order to produce a raising effect, and/or at least in part inwardly into the tubular manufactured article, with a swelling effect.

The equipment according to the invention, for producing the abovementioned yarn by means of the process detailed above consists essentially of: at least one means for feeding a corresponding roving or fiber top to be loosened until it acquires the form of a light batting; at least one revolving card device to which the said roving is fed, which card device thins the fibers of said roving; means forming a cavity for conveying said loosened fibers; a binding chamber having thread-guide passages enabling binding threads to enter into said chamber; and means for manufacturing said binding yarns so as to form thereby a threadlike manufactured article engaging the loosened fibers fed to said binding chamber.

Said means for manufacturing the binding yarns may comprise a twisting device connected to said binding chamber, and consisting of a spindle system, or a hollow spindle system having a winding cheese or the like. Alternatively, said means for manufacturing the binding yarns may comprise a knitting machine suitable for producing an essentially threadlike manufactured article, the needles' working area being within said binding chamber; the machine may be a circular knitting machine having a limited number of needles, of the type that produces thin knitted tubular manufactured articles with one or more falls and having a continuously rotating equipment bearing the needles or the means for controlling the needles.

The equipment may comprise means for varying the speed of the card and/or means for varying the speed of the feed roller, even until the latter are brought to a standstill. Several feed rollers may be arranged around the said card. Further, several cards may be provided for feeding a same cavity connected to the binding means. The equipment may also comprise a nozzle for producing temporary air jets suitable for the intermittent disposal of fibers which accumulated upstream of the fiber binding area. Finally the equipment may also comprise means for varying the slipping speed of the binding threads. All of the above arrangements make it possible to vary the characteristics of the fancy yarn.

BRIEF DESCRIPTION OF THE DRAWINGS

The finding will be better understood following the description and the attached drawing, which shows a practical non-limiting exemplary embodiment of the said finding. In the drawing:

FIGS. 9 and 10 show a portion of tubular yarn in a side view and partial section and in transverse section;

FIG. 11 shows a further sectional embodiment of the equipment for the production of the yarn of FIGS. 9 and 10;

FIGS. 12 and 13 show diagrammatically two further embodiments of the equipment.

DETAILED DESCRIPTION OF THE PREFERRED EMBODIMENT

Figure 1:
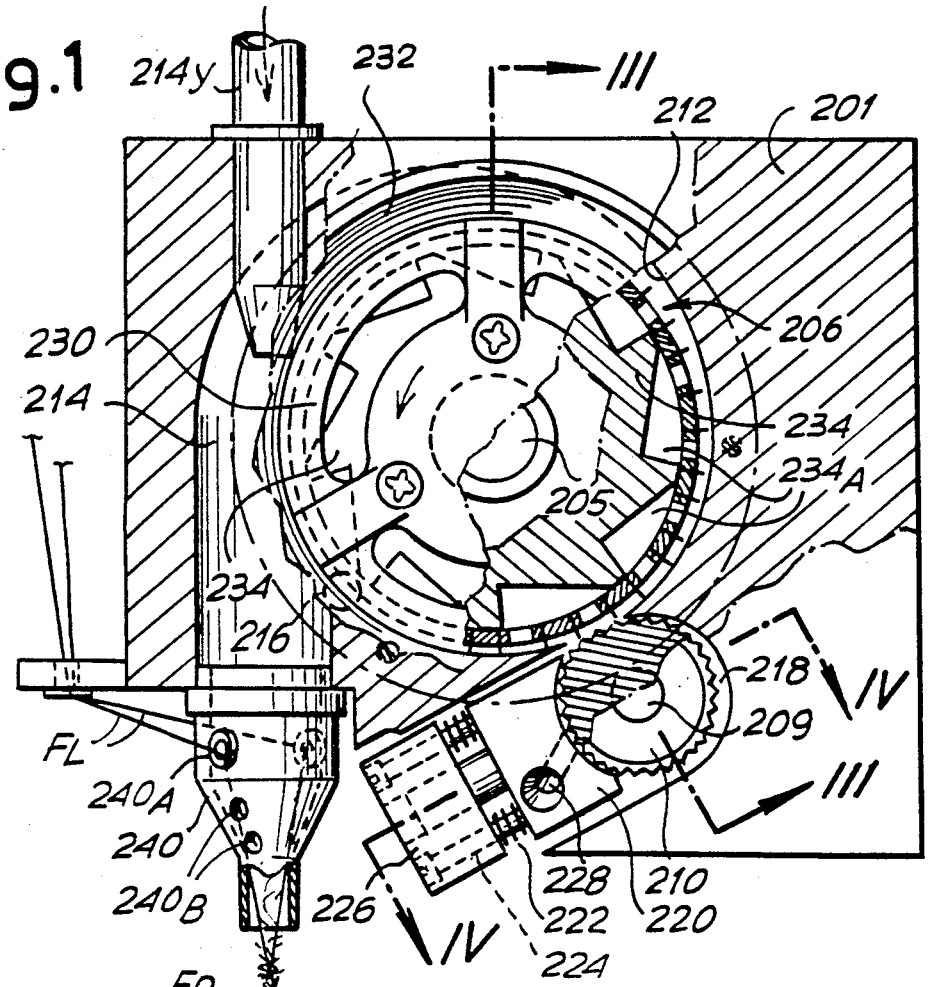
FIG. 1 shows a first embodiment of the equipment, having binding means in the form of twists.
Figure 1:
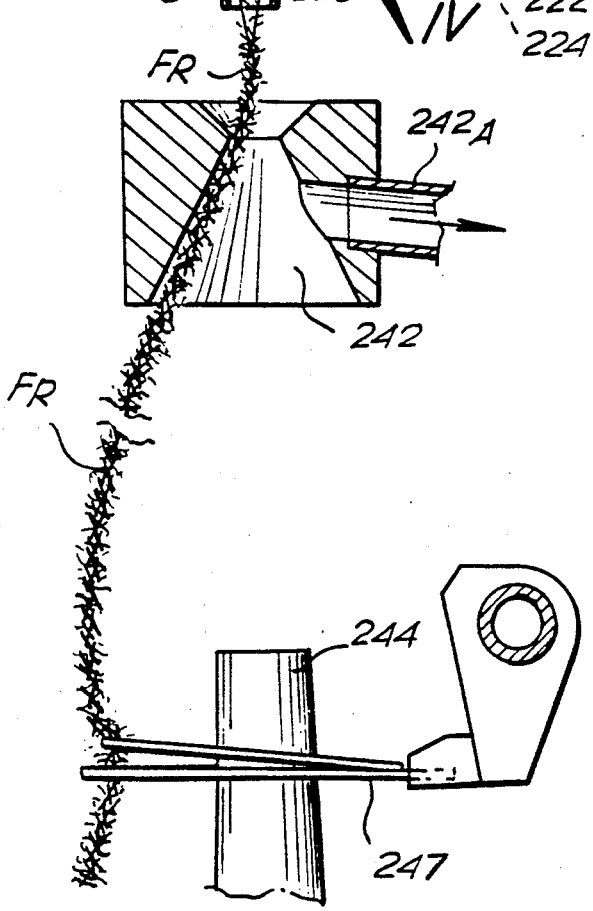
Figure 2:
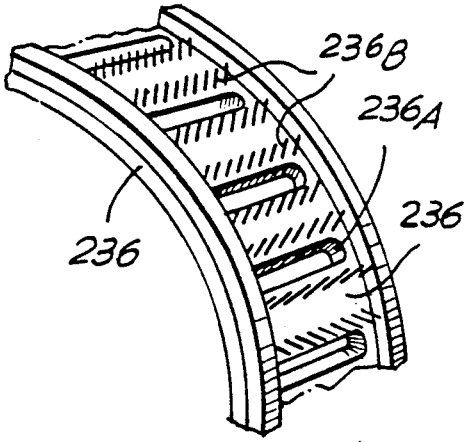
FIG. 2 shows a detail of the card, in perspective view.

According to FIGS. 1 to 4, 201 denotes a block, in which a rotation seat 203 is formed for a shaft 205 bearing a card generally denoted by 206. A second rotation seat 207 is formed by an eccentric bush 208 and is used for a shaft 209 bearing a feed roller 210 having a perimetral covering; by regulating the angular position of the bush 208 the position of the roller 210 is regulated with respect to the card. The block 201 forms for the card 206 a molded housing 212 with a radial dimension which increases in the direction of rotation of the card 206, shown by the arrow fc; the cavity delimited by said housing and by the card 206 radially increases starting from the feed roller 210 and extends into a cavity 214 forming a binding chamber which extends tangentially with respect to the housing for the card 206 and to the said card. The edge between the housing of the card and the cavity 214 is formed (FIG. 6) by a hardened block 216, which may be replaced in the event of wear caused by the fibers; this block 216 may be obtained by a leveling of a pin which may be inserted into a seat of the block 201; by rotating the pin the position of the edge may be regulated with respect to the periphery of the card 206.

The feed roller 210 is placed into a housing 218, which is delimited in part by the block 201 and in part by a regulating block 220, which is moved towards the roller 210 by springs 222 wound around guide pins 224 brought by a support 226. The housing 218 is shaped to form a conduit at least in the area of the regulating block 220, and in said block a sloping and laterally opening hole 228 is bored, to feed the top or fiber roving to the feed roller 210. Said feed roller 210 is caused to rotate slowly and its speed can be controlled. The housing 212 for the card 206 is laterally closed by a disk like grate cover 230, together with an air intake 232 having a truncated cone shape.

The card 206, brought by the shaft 205, is produced in the form of a rotor for drawing air from the intake 232 and for conveying it into the cavity 212 and then into the cavity 214. To this end the card 206 exhibits a molded body 234 having cavities 234A which, by opening laterally opposite the grate 230 reach the periphery of the said body, onto which a cover 236 is fixed; the latter exhibits (see FIG. 2) slits 236A for the escape of air as well as wires 236B constituting the card covering.

Figure 3:
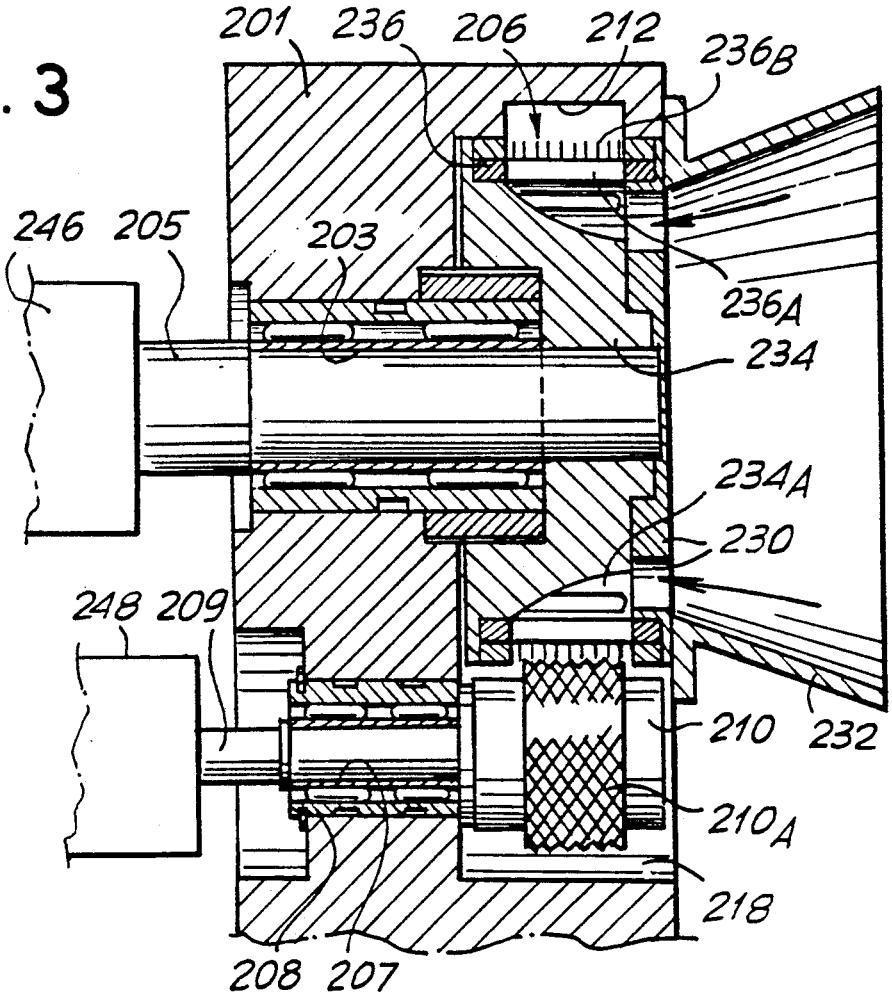
FIGS. 3 and 4 show two local sections according to lines III—III and IV—IV in FIG. 1.
Figure 4:
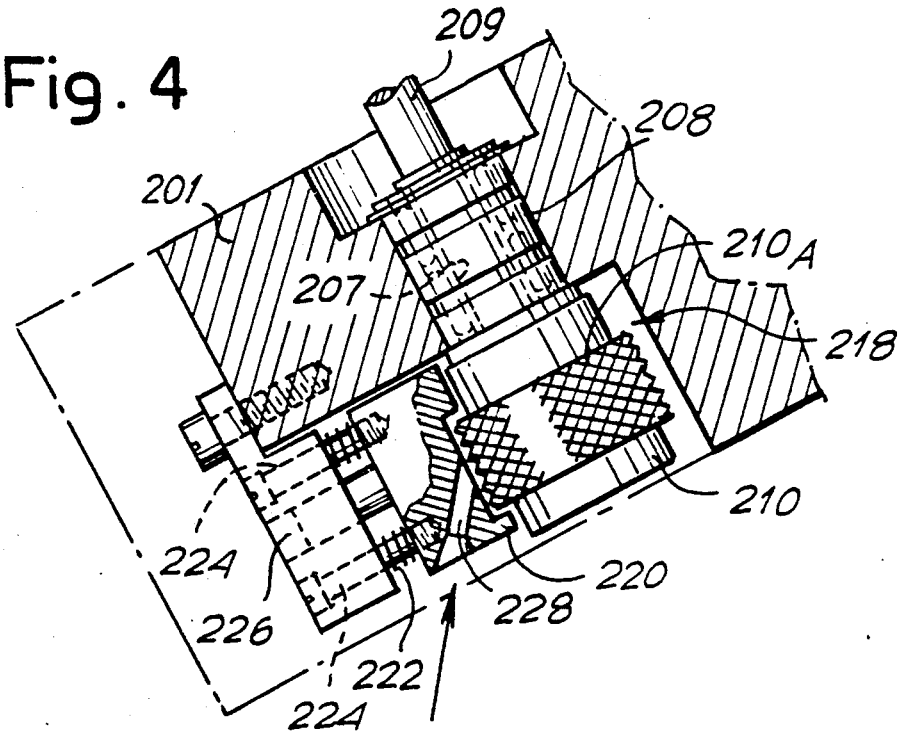

In FIG. 3, 246 generally denotes means for controlling in rotation the shaft 205 with a speed which may be varied even up to zero and which may also be varied cyclically. 248 generally denotes means for controlling in rotation the shaft 209 with a speed which may be varied even up to zero and which may also be varied cyclically.

Figure 6:
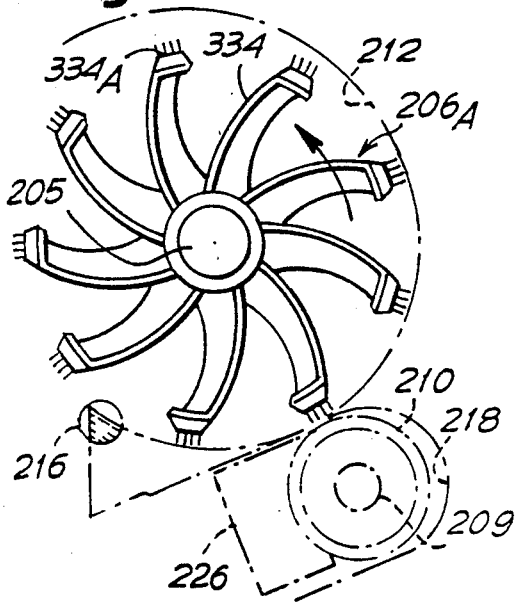
FIG. 6 shows an embodiment variant of the card.
Figure 5:
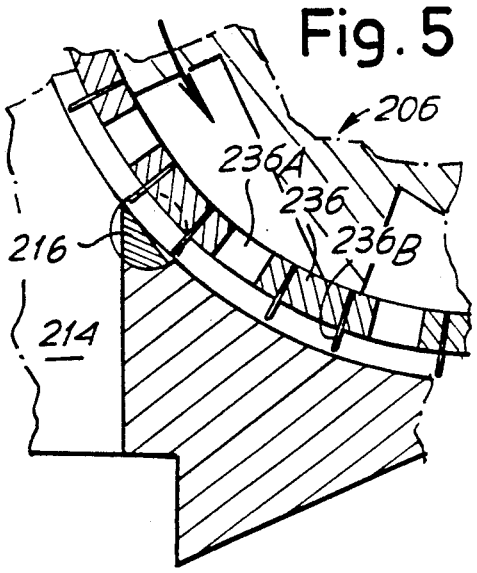
FIG. 5 shows an enlarged detail of FIG. 1.

According to the embodiment variant in FIG. 6, the card 206A is shaped in the form of a fan 334, at the ends of whose blades peripheral covering areas 334B are formed for its function as a card.

By rotating the card, a draught is determined radially in a centrifugal direction through the covering of the said card, which rotation enables the separation of the fibers toward the housing 212 and toward the cavity 214, without having to make use—due to a high centrifugal effect—of a high rotation speed of the card. This reduces the breakage of the fibers and makes the thinning of the fibers fed by the roller 210 particularly regular.

Downstream of the cavity 214 the feeding of binding yarns is provided for engaging the fibers delivered by the card, or through the twisting of two or more binding threads—through spindle means, ring means or the like—or through the production of knitted manufactured articles, for instance thread-like tubular manufactured articles, into whose knits the fibers protruding outside the manufactured article and also inside, are caught, thus swelling it in a very soft way. The draught tends directly to eliminate the fibers which are not anchored to the binding threads and to recover them.

By varying the rotation speed of the feed roller 210 the characteristics of the thread being produced may be varied. Two or more feed rollers 210 may also be provided along the periphery of a same card, actuated with possible speed variations ranging from zero to a maximum, and/or two or more cards for delivering different fibers to the same cavity 214, so as to vary type and/or quantity of fibers to the card. Anomalous rovings, having possible lumps of fibers, may also be fed. Clusters of lumps of fibers may also be determined, which lumps stagnate and are periodically disposed of by an air jet formed through the cavity 214, in the direction of its axis and determined by a nozzle 214Y, in order to be bound by the binding threads; the binding threads are temporarily stopped, to obtain the accumulation of the fibers.

According to the embodiment in FIG. 1 a conelike condensing device 240 is connected to the cavity 214, which device completes the binding chamber; said device 240 exhibits lateral holes 240A for binding threads FL, and holes 240B for the escape of air outwards. Both the holes 240A and the holes 240B may be circularly distributed; preferably one or more holes 240B are below the holes 240A, which holes 240A form thread guides for the entry of the binding threads. The twists almost reach the exit of the condenser 240, and the binding threads are unraveled in the binding chamber to engage the majority of the fibers coming from the cavity 214; a few fibers may be lost through the holes 240B and below the condenser 240. Downstream of the condensing device 240 the twisting means is arranged, in the form of a spindle, a ring device, or the like.

According to FIG. 1 a twisting group of the conventional type is shown which uses the two or more binding threads FL by twisting them in such a manner that they engage the fibers delivered by the card 206 or 206A and which travel through the condenser 240. The twisted thread FR (formed by the binding threads FL and by the fibers caught in between them) passes through a suctioning chamber 242, formed by two sections of truncated cones opposite one another and from which a conduit 242A for suctioning the residuary free fibers is formed. Below the chamber 242 the balloon B extends which is formed by the conventional ring (not shown) integral with a spindle 244 for producing the skein of twisted yarn; 247 denotes a ring limiting the balloon; the annular track of the ring is moved along the spindle for the production of the skein. The suctioning pipe 242A is used to recover from the chamber 242 the fibers not engaged by the twisted threads FL.

Figure 7:
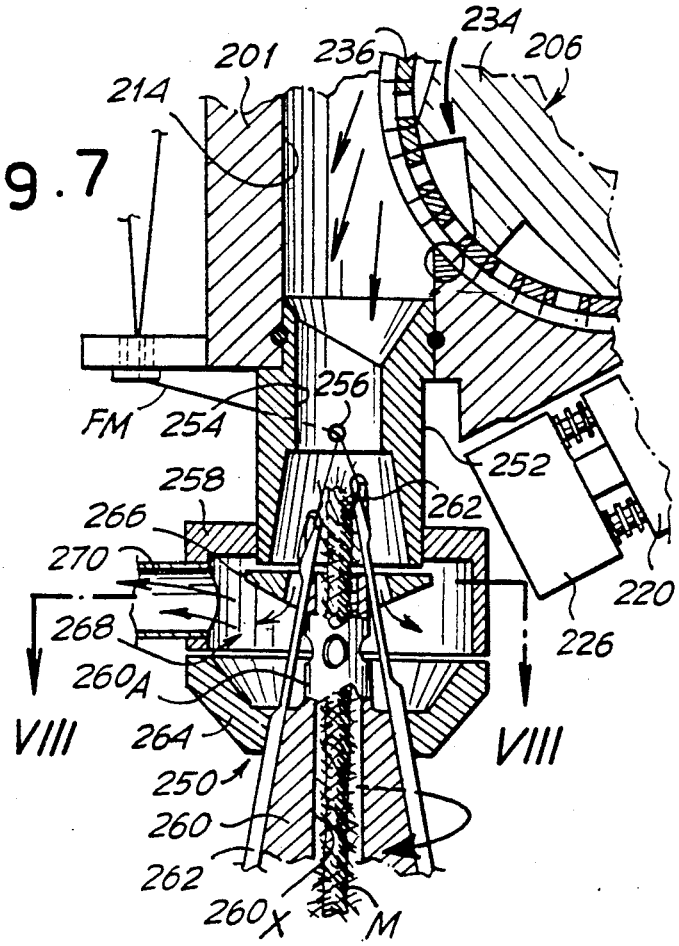
FIGS. 7 and 8 show, in axial section and in the transverse section according to VIII—VIII in FIG. 7, a second embodiment of the equipment, having binding means which comprise a circular knitting machine.
Figure 8:
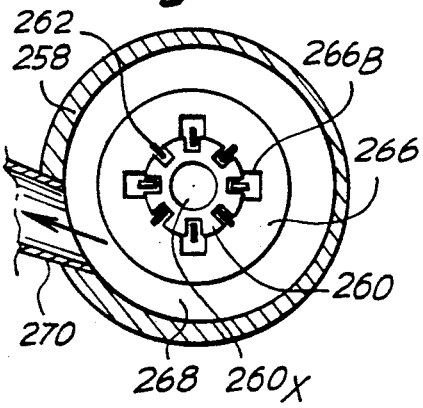

In FIGS. 7 and 8 an embodiment is shown in which a circular knitting machine 250 is provided, suitable for producing a thin knitted tubular manufactured article having one or more knitted binding threads FM. 252 denotes a device having two off-center bodies, which device is inserted into the cavity 214 and which exhibits an inlet 254 for the draught together with the fibers and coming from the card; said inlet 254 together with the cavity 214 completes the binding chamber. The thread or threads FM enter into the inlet 254 through holes 256. A member 258 in the form of a reversed cup is connected to the device 252. The needle roller 260 for the needles 262 is shaped having the conduit-like seats arranged according to a conical progression, in a manner such that the area for producing the knit is located in the lower part of the inlet 254. The needle roller 260 is annularly inbuilt in 260A and engages two disklike members 264 and 266; the disklike member 264 together with the cup member 258 determines a suctioning chamber 268, connected to a lateral suctioning conduit 270; the disklike member 266 is located opposite the outlet of the inlet 254 and together with the roller 260 forms air inlets 266B. The needles produce the knitted tubular manufactured article M and the fibers coming from the card are engaged in the knits; the fibers engaged by the knits protrude outwardly and inwardly from the tubular manufactured article thus produced. The fibers which are not engaged are recovered by the chamber 268 through the suctioning conduit 270. The manufactured article M moves away through an axial hole 260X of the roller 260, and is wound around a bobbin or the like.

In FIGS. 9 and 10 a yarn is shown according to the invention having a knitted tubular manufactured article binding. 1 denotes a knitted tubular fabric, which is relatively very thin and hence linear, to form in practice the main body of a fancy yarn. The knitted tubular structure 1 is connected to a plurality of loosened fibers which are in part, as denoted by 3, even contained inside the woven tubular structure 1, and in part, as denoted by 5, engaged to the structure of the knit of the tubular fabric 1 and protruding outwardly. In practice, each of the fibers may be anchored to the structure of the knitted tubular fabric 1 and may protrude to a lesser or larger extent, outwardly of the said structure, or be predominantly inwardly of the said structure, respectively, rather than exhibit completely free fibers as the fibers 3. In any case, the resulting yarn is a fancy yarn having a tubular structure and an internal swelling consisting of the loosened fibers or parts of fibers 3 and 5, which are contained within the tubular structure, and having a down consisting of the fibers 5 protruding from the tubular structure of knitted fabric and anchored to the said structure. This results in the production of a fancy yarn manufactured article which is particularly valuable both on account of its swelling effect and of the down effect of the yarn surface, and also for its characteristics of high lightness together with its high heat insulating ability. A yarn of this type is certainly valuable for the manufacturing of external items of clothing, in particular women's clothing and in any case having the characteristics of high heat insulation and of high lightness and softness.

FIG. 11 shows a further embodiment of the equipment for producing the yarn of FIGS. 9 and 10. In the drawing, 12 generally denotes the structure of a machine for the production of a knitted tubular article, which machine is very small and has few needles; 14 denotes in particular a needle roller enabling the sliding of the needles 16 in grooves cut on the surface of the roller the roller 14 in the machines of this type may generally be arranged having a truncated cone progression —rather than a cylindrical one—to enable a substantial approach of the needles in the region of the area for producing the knits. The needles are controlled by a wipper cover of the conventional type which is placed inside the structure of the machine 12, to control the needles for picking up the thread in the region of the fall or of each of the falls and for the lowering of the needle for producing the knit. The drawing provides for the existence of two feeding threads that is of two falls F1 and F2, hence the wipper cover for controlling the needles will be shaped so as to impose on each needle at every turn two upward runs and two downward runs for producing the knits. Alternatively the equipment of the needles may also be provided fixed and the wipper cover rotating.

According to the invention, a machine of the above mentioned type is connected to a group for feeding loosened fibers which are intended to be engaged in the manufactured article 1 as inner fibers 3 or outer fibers 5, engaged at least in part in the knit produced by the needles 16. The roller 14 is surrounded by a tubular sheath structure forming the binding chamber. The said sheath comprises—according to the drawing—a first tubular section 18 surrounding the roller 14 proper and partially at least the needles' working area that is the area for producing the knit; said section 18 exhibits a plurality of connecting holes 20 between the inside and the outside of the said section 18. A second tubular sheath section 22 is grafted onto the section 18 in the region of the needles' working area, and this section 22 exhibits—according to the drawing—holes 24 for the passing of the threads F1 and F2 of the two falls; said holes 24 correspond to recesses 26 provided on the upper edge of the section 18. The holes 24 form in practice thread guides of the yarn falls F1 and F2 for feeding the thread to the needles. The tubular section 22 of the sheath structure is connected to a fiber feeding device generally denoted by 30.

Said device 30 comprises in particular a card 32 which rotates at relatively high speed and which has a perimetral covering, this card being of the type of those used for instance for feeding loosened fibers to the so-called "open-end" spinning heads and the like. At least one feed roller 34 co-operates with this card 32, said roller being fed by a fiber roving which reaches the device through a hole 36 and which is caused to pass between the feed roller 34 and a regulating block 38 which can be recorded for its nearing and its distancing with respect to the feed roller 34. The fiber material of the roving is thus fed in the direction of the arrow fA to the periphery of the card 32 equipped with covering. The card 32 thins the fibers and projects them into an essentially cylindrical cavity 40, onto which the section 22 of the abovementioned sheath structure 22, 18 is grafted. The drawing provides for two different feeds for the card 32 having two feed rollers 34, two inbound conduits 36 for the roving and two regulators 38. This arrangement may be used for feeding alternately two types of rovings to the card 32, by once stopping one feeding group and then the other, or to feed the roving of just one group while intermittently adding further material from the second roving, or in any case in order to obtain specific effects in the feeding of the fibers which are projected into the cavity 40 and brought from the same during the fall up to the working area of the needles 16, in order to be engaged by the needles and then by the knits produced by the said needles by means of the threads F1 and F2.

An acceleration pneumatic effect in the direction of the arrow fP may be provided, to make the approach of the fibers easier, by inducing a light conveying pneumatic current; the latter may also on the other hand be directly induced both by the fast rotation of the card 32 and by the effect caused by the motion of the needles in the area for producing the knits.

The holes 20 enable the escape of air; the presence of a larger or smaller number of uncovered holes 20 may also cause a desired and variable distribution of the fibers between the inside and the outside of the knitted tubular structure 1 of the manufactured article being produced; in fact, a greater air escape through the holes 20 causes a tendency toward the positioning of the fibers in the array of the abovementioned fibers 5, that is to say protruding from the tubular manufactured article, whereas a lesser escape draught through the holes 20 may cause a larger presence of swelling fibers within the knitted tubular structure. Suitable means may be provided for regulating the apertures toward the outside through the section 18, that is to vary the number of uncovered holes 20 and/or to plan in a stable way a specific opening state of the said holes for each manufacturing process.

As better shown in FIGS. 12 and 13, a fiber feeding device may also provide a further group having a card and roving feed or feeds, in any case to be connected to the cavity 40 (or to the cavity 214) overlooking the needles' working area and the needle roller. Various effects in the texture of the resulting threadlike manufactured article may be obtained by means of possible combinations in the feeds of the rovings, as well as variations in the thickness and quality and/or color of the fibers which are subsequently engaged during the production of the threadlike tubular manufactured article.

The threadlike tubular manufactured article descends—in the course of being produced—inside the needle roller 14 to be appropriately collected in the manner known per se in machines of the type of the above mentioned machine 12, 14.

The size of the tubular sheath structure consisting —in the drawing—of the tubular sheath sections and 22 will be determined by the size necessary for the working of the needles and of their blades in the area for producing the knits.

A larger number of needles causes a larger presence of fibers within the knitted tubular structure, whereas a smaller number of needles causes a larger occurrence of fibers protruding outwardly of the knitted tubular structure and anchored thereto. These regulating possibilities add to those caused by the presence of the holes for the escape of air from the section 18 downstream of the needles' working area. A substantial control shutting of the holes 20 and hence a greater concentration of the fibers within the knitted tubular structure may even be provided, or a greater predominance of fibers which are external and bound to the knitted structure through a smaller number of needles and a greater pneumatic current proceeding from the holes 20. A knitted structure produced by very few needles or even by a single needle may even be envisaged, whose successive chain knits bind the fibers coming from the card and from the cavity 40.

The case is not to be excluded where the fibers which are not engaged by the tubular structure, especially the very short ones, may be collected by recovering the fibers from the current proceeding from the holes 20, without excluding the further possibility of a distancing of the fibers which might accumulate at the bottom of the roller 14, by means of pneumatic suctioning or the like.

FIGS. 12 and 13 generally show embodiments for producing loosened fibers variable in their nature and/or in their color, for obtaining particular effects, which may also be cyclically variable and which add to and combine with the effects obtained by the variation of the feeding speed of the roving or top and/or of the card.

FIG. 12 shows a card 102, which delivers the fibers to a cavity 104 and then to the binding chamber. Two feed rollers 106 and 108 co-operate with the periphery of the card 102, which rollers are fed by two different rovings, each of the rollers being produced and completed by elements already described. By alternating the actuation of the two feed rollers 106, 108 and/or by varying their rotation speeds, the card may be variably fed and the flow of fibers may thus be varied in the form of light batting, which fibers are then bound in the ways already described.

FIG. 13 provides for at least two cards 152, 154 to be able to discharge loosened fibers to a common cavity 156, connected to a binding chamber. Each of the two cards 152 and 154 is connected to two feed rollers 158, 160 and 162, 164 respectively, which feed as many tops or rovings. By alternating the working of the two cards, and by varying their feeds as already shown above, many possibilities of varying the flow of the fibers to be bound with the binding yarns are obtained.

We claim:

1. Apparatus for producing a fancy yarn having a threadlike part with ends of bound fibers protruding laterally outwardly therefrom comprising:

a housing:

a rotary carding device having a rotational periphery;

means for rotatively mounting the carding device in the housing;

means for feeding a fiber roving or top to the rotary carding device so that the fibers are loosened and thinned thereby to form a light batting;

means forming a binding chamber having a binding zone adjacent the housing;

means defining a passageway extending between the carding device and the binding chamber for feeding said loosened and thinned fibers from the carding device to the binding zone;

thread admitting and guiding passageways provided on the binding chamber for enabling binding threads to enter the binding chamber for longitudinal feeding through the binding zone; and, means adjacent the binding zone for operating said binding threads to bind the loosened and thinned fibers in the binding zone thereby to form the threadlike part with bound fiber ends protruding laterally outwardly therefrom.

2. Apparatus according to claim 1 wherein said means for operating the binding threads comprises a twisting device operably connected to said binding chamber for twisting said binding threads around each other in a longitudinal direction bindingly to engage the loosened and thinned fibers therebetween.

3. Apparatus according to claim 2 further comprising a suction device including a chamber comprising a biconical conduit having axially connected converging and diverging portions arranged to receive the twisted threads for longitudinal passage axially therethrough and means communicating with the chamber for extracting free fibers therefrom.

4. Apparatus according to claim 3 wherein the binding chamber has opposite ends forming a fiber inlet and a fiber outlet, respectively, with the fiber inlet end being joined to the passageway, a suction extraction chamber extends around the continuously rotatable member for extracting free fibers therefrom, said extraction chamber comprising a stationary cup-like member encircling the fiber outlet end and first and second disc-like members carried for axial rotation by the rotatable member, the first disc-like member being mounted to close the mouth of the cup-like member and the second disc-like member extending across the fiber outlet of the binding chamber and being provided with air inlets extending between the binding chamber and the extraction chamber.

5. Apparatus according to claim 1 wherein said means for operating the binding threads comprises a knitting machine for producing the threadlike part and having a knitting needle working area within said binding chamber adjacent said binding zone.

6. Apparatus according to claim 5 wherein said knitting machine comprises a circular knitting machine having a limited number of needles for producing the threadlike part as a thin knitted tube with one or more falls and having a continuously rotatable member operably connected to the needles.

7. Apparatus according to claim 6 wherein the binding chamber comprises a tubular sheath structure surrounding the knitting needle working area and the binding zone said thread guiding and admitting passageways being located upstream of said working area and said binding zone.

8. Apparatus according to claim 7 wherein a wall portion of the sheath axially spaced downstream from said thread guiding and admitting passageways is formed with air outlets.

9. Apparatus according to claim 1 wherein the housing is formed with a cavity wherein the carding device is mounted, the cavity having a spiral, circumferential wall with a radial dimension which progressively increases as the cavity extends in the direction of rotation of the carding device thereby to provide a conduit of progressively increasing width extending adjacent the rotational periphery of the carding device and having a fiber entry end adjacent the fiber feeding means and a fiber exit end communicating with the passageway which extends tangentially of said cavity, thereby to thin the fibers and to deliver the thinned and loosened fibers to the binding chamber, means being provided to produce an air current from the carding device along the passageway to said binding chamber.

10. Apparatus according to claim 9 wherein the carding device comprises and air pervious cover mounted on the rotational periphery thereof and a central rotor body having the form of a ventilating rotor arranged to draw air axially therein and impel air centrifugally therefrom through the cover into the housing cavity.

11. Apparatus according to claim 10 wherein the cover comprises a tubular band which is formed with axially extending slits and the central body is formed with peripheral air trapping cavities opening adjacent said slits and laterally of said rotor body.

12. Apparatus according to claim 9 wherein the rotary carding device comprises a bladed fan having carding teeth mounted on radially outermost end portions of each blade.

13. Apparatus according to claim 1 wherein the feeding means comprises a feed roller mounted on the housing adjacent the rotary carding device and a feed block having a fiber outlet face and a fiber inlet face extending transversely of and adjacent the fiber outlet face, resilient means urging the block radially towards the roller surface so that the roller surface rotates past the fiber outlet face, a feed bore extending obliquely through the block from the fiber inlet face to the fiber outlet face thereof for feeding the fiber roving or top to the roller surface.

14. Apparatus according to claim 13 wherein the feed roller is mounted on an eccentric bush adjustable for regulating the separation of the feed roller from the rotational periphery of the rotary carding device.

15. Apparatus according to claim 13 comprising means for varying at least one of the rotational speed of the carding device and the feed roller.

16. Apparatus according to claim 13 comprising a plurality of feed rollers arranged at spaced apart locations around the rotational periphery of the carding device.

17. Apparatus according to claim 1 wherein the binding chamber has a wall with a truncated cone shaped portion which converges as it extends away from the passageway and provides a fiber condenser, the thread admitting passageways being formed by apertures in the wall and air vents being formed in the truncated cone shaped portions.

18. Apparatus according to claim 1 wherein a member defining a hardened edge is mounted between the housing and said passageway, said member being formed by a flat extending along a pin, means being provided for mounting the pin for rotation about a longitudinal axis for varying the clearance with the rotational periphery of the carding device.

19. Apparatus according to claim 1 including a plurality of rotary carding devices arranged to feed a common passageway extending to the binding chamber.

20. Apparatus according to claim 1 comprising means for supplying air jets intermittently to the passageway for removal of any fibers accumulating upstream of the binding zone.

21. Apparatus according to claim 1 comprising means for varying the slipping speed of the binding threads.

* * * * *